US011209763B2

(12) United States Patent
Shimodaira

(10) Patent No.: US 11,209,763 B2
(45) Date of Patent: Dec. 28, 2021

(54) PAPER GUIDE MEMBER AND IMAGE FORMING APPARATUS

(71) Applicant: FUJIFILM Business Innovation Corp., Tokyo (JP)

(72) Inventor: Akira Shimodaira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 132 days.

(21) Appl. No.: 16/522,878

(22) Filed: Jul. 26, 2019

(65) Prior Publication Data

US 2020/0264549 A1 Aug. 20, 2020

(30) Foreign Application Priority Data

Feb. 14, 2019 (JP) ..... JP2019-024844

(51) Int. Cl.
*G03G 15/00* (2006.01)

(52) U.S. Cl.
CPC ..... *G03G 15/6529* (2013.01); *G03G 2215/00409* (2013.01); *G03G 2215/00649* (2013.01)

(58) Field of Classification Search
CPC ... G03G 15/65–80; G03G 2215/00409; G03G 2215/00649; B65H 2404/50–5631
See application file for complete search history.

(56) References Cited

U.S. PATENT DOCUMENTS 5,477,314 A * 12/1995 Tsuchiya ..... G03G 15/657 399/107
2010/0278574 A1 11/2010 Miyazawa

FOREIGN PATENT DOCUMENTS

JP 2010-262040 A 11/2010

* cited by examiner

*Primary Examiner* — Justin N Olamit
(74) *Attorney, Agent, or Firm* — Sughrue Mion, PLLC

(57) ABSTRACT

A paper guide member includes plural thread-shaped protrusions extending in a passing direction of paper to guide the paper after a toner image is transferred so that the paper passes with a distance secured from a static eliminator that eliminates static electricity in proximity to the paper in a width direction of the paper. The plural thread-shaped protrusions adjoin each other across a slit in the width direction of the paper. The plural thread-shaped protrusions include first thread-shaped protrusions each having a height at which the paper is supported and guided, and second thread-shaped protrusions each having a height smaller than the height of each of the first thread-shaped protrusions and present in regions on an outer side of both ends in the width direction of each passing region where paper having each width passes.

9 Claims, 9 Drawing Sheets

PAPER GUIDE MEMBER AND IMAGE FORMING APPARATUS

CROSS-REFERENCE TO RELATED APPLICATIONS

This application is based on and claims priority under 35 USC 119 from Japanese Patent Application No. 2019-024844 filed Feb. 14, 2019.

BACKGROUND

(i) Technical Field

The present disclosure relates to a paper guide member and an image forming apparatus.

(ii) Related Art

For example, Japanese Unexamined Patent Application Publication No. 2010-262040 (claims 1 and 2, FIGS. 2 and 4, etc.) describes a technology related to a paper guide member capable of preventing guided paper from being smeared due to adhesion of toner.

Japanese Unexamined Patent Application Publication No. 2010-262040 (claims 1 and 2, FIGS. 2 and 4, etc.) describes a guide member that guides, to a fixing part, a sheet having a toner image transferred by a transfer part and has a plurality of projections and recesses formed at a downstream end of the guide member in a sheet transport direction and arrayed in a direction orthogonal to the sheet transport direction, and describes an image forming apparatus that uses the guide member. Japanese Unexamined Patent Application Publication No. 2010-262040 (claims 1 and 2, FIGS. 2 and 4, etc.) describes that the guide member may prevent flying toner from adhering to the trailing edge of the sheet.

SUMMARY

Aspects of non-limiting embodiments of the present disclosure relate to a paper guide member and an image forming apparatus in which a back smear, which is adhesion of toner to the back surface of paper that is relatively wider than preceding paper among sheets of paper guided so that static electricity is eliminated after a toner image is transferred, may be reduced compared with a case in which the heights of all of a plurality of thread-shaped protrusions that support and guide paper are equal in a width direction of the paper.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a paper guide member comprising a plurality of thread-shaped protrusions extending in a passing direction of paper to guide the paper after a toner image is transferred so that the paper passes with a distance secured from a static eliminator that eliminates static electricity in proximity to the paper in a width direction of the paper. The plurality of thread-shaped protrusions adjoin each other across a slit in the width direction of the paper. The plurality of thread-shaped protrusions comprise first thread-shaped protrusions each having a height at which the paper is supported and guided, and second thread-shaped protrusions each having a height smaller than the height of each of the first thread-shaped protrusions and present in regions on an outer side of both ends in the width direction of each passing region where paper having each width passes.

BRIEF DESCRIPTION OF THE DRAWINGS

An exemplary embodiment of the present disclosure will be described in detail based on the following figures, wherein.

DETAILED DESCRIPTION

An exemplary embodiment of the present disclosure is described below with reference to the drawings.

EXEMPLARY EMBODIMENT

Figure 1:
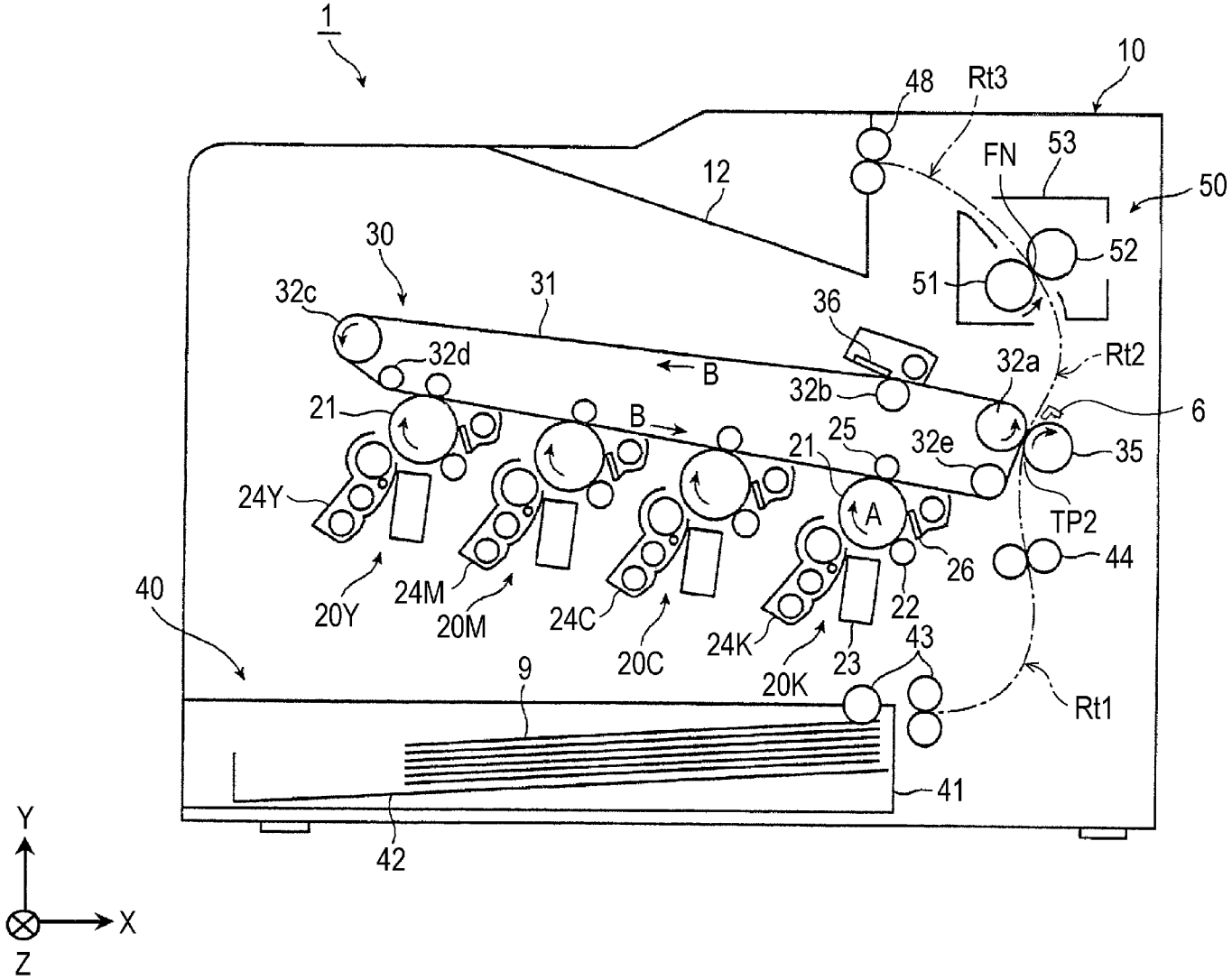
FIG. 1 illustrates the structure of an image forming apparatus according to an exemplary embodiment.
Figure 2:
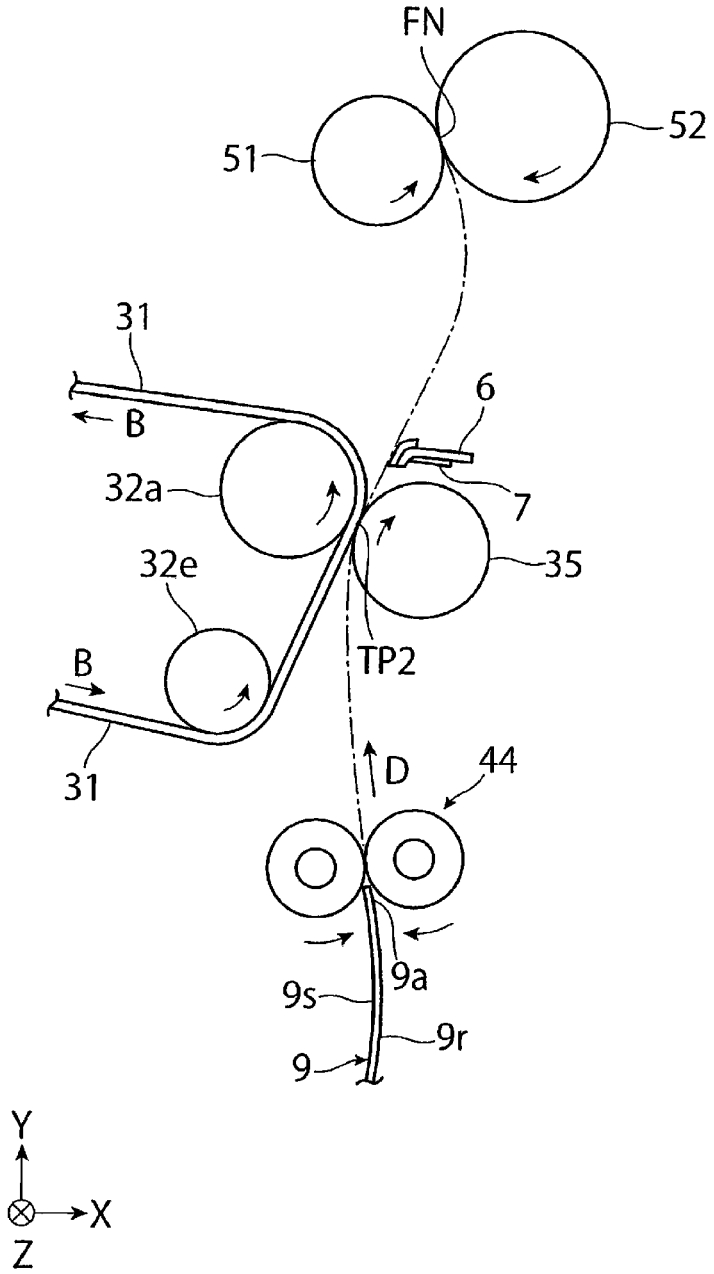
FIG. 2 illustrates a portion of the image forming apparatus of FIG. 1.

FIG. 1 and FIG. 2 illustrate an image forming apparatus 1 according to the exemplary embodiment. FIG. 1 illustrates the structure of the image forming apparatus 1. FIG. 2 illustrates the structure of a portion of the image forming apparatus 1 (including a second transfer part and its periphery).

In the drawings, arrows indicated by reference symbols X, Y, and Z represent width, height, and depth directions in a three-dimensional space assumed in the drawings. In FIG. 1, FIG. 2, and the like, a circle located at an intersection of the arrows representing the X and Y directions shows that the Z direction is oriented to a far side orthogonally to the drawings.

Structure of Image Forming Apparatus

For example, the image forming apparatus 1 uses an electrophotographic image forming system to form an image with toner serving as a developer on paper 9 that is an example of a recording medium. For example, the image forming apparatus 1 of the exemplary embodiment is a printer that forms an image corresponding to image information acquired from an external apparatus such as an information terminal.

As illustrated in FIG. 1, the image forming apparatus 1 includes, in an internal space of a housing 10, image forming units 20 that form unfixed toner images with toner based on image information, an intermediate transfer unit 30 that temporarily holds and transports the toner images formed by the image forming units 20 and then secondly transfers the toner images onto the paper 9, a paper feeder 40 that contains sheets of paper 9 to be fed to a second transfer position of the intermediate transfer unit 30 and feeds the sheets of paper 9 to the second transfer position, a fixing unit 50 that fixes, onto the paper 9, the toner images secondly transferred by the intermediate transfer unit 30, and a paper guide member 6 that guides the paper 9 having the secondly transferred toner images so that static electricity is eliminated.

The housing 10 is a structural object formed to have a desired structure and shape from various materials such as support members and covering materials. A paper output/reception part 12 that receives sheets of paper 9 output after image formation in a stacked state is formed at a portion of the top of the housing 10. A chain line in FIG. 1 or the like indicates a major transport path of the paper 9 in the housing 10.

For example, the image forming units 20 are four image forming units 20Y, 20M, 20C, and 20K dedicated to formation of toner images of four colors that are yellow (Y), magenta (M), cyan (C), and black (K), respectively.

Each of the four image forming units 20 (Y, M, C, K) includes a photoconductor drum 21 that is an example of a photoconductor. A charging device 22, an exposure device 23, a developing device 24 (Y, M, C, K), a first transfer device 25, a drum cleaner 26, and other devices are arranged around the photoconductor drum 21. For convenience, all the reference symbols 21 to 26 are placed only on the black (K) image forming unit 20K in FIG. 1 and a subset of the reference symbols is placed on the image forming units 20 of the other colors (Y, M, C).

In the image forming unit 20 (Y, M, C, K), a part where the photoconductor drum 21 and the first transfer device 25 face each other across an intermediate transfer belt (31) described later is a first transfer position where the toner image is firstly transferred.

The outer peripheral surface of a cylindrical drum body of the photoconductor drum 21 is an image formation surface formed of, for example, a photoconductive layer. The photoconductor drum 21 rotates in a direction indicated by an arrow A. The charging device 22 charges the outer peripheral surface of the photoconductor drum 21 at a desired polarity and potential. The exposure device 23 exposes the outer peripheral surface of the photoconductor drum 21 to light based on image information to form an electrostatic latent image of a desired color component (Y, M, C, K) and potential.

The developing device 24 (Y, M, C, K) visualizes the electrostatic latent image formed on the outer peripheral surface of the photoconductor drum 21 by developing the electrostatic latent image under a developing electric field by using toner of a desired color (Y, M, C, K) corresponding to the color component. The first transfer device 25 transfers the toner image of each color onto the intermediate transfer unit 30 (intermediate transfer belt 31) at the first transfer position. For example, the first transfer device 25 is a contact type transfer device having a first transfer roller that presses the intermediate transfer belt 31 against the photoconductor drum 21 and is supplied with a first transfer bias. The drum cleaner 26 cleans the outer peripheral surface of the photoconductor drum 21 by removing unwanted objects such as toner or paper dust adhering to the outer peripheral surface.

The intermediate transfer unit 30 is arranged above the image forming units 20 (Y, M, C, K) in the housing 10. The intermediate transfer unit 30 includes the intermediate transfer belt 31 that transports the toner images firstly transferred from the photoconductor drums 21 of the image forming units 20 (Y, M, C, K) to the second transfer position for the paper 9, a second transfer device 35 that secondly transfers the toner images on the intermediate transfer belt 31 onto the paper 9, and a belt cleaner 36 that cleans the outer peripheral surface of the intermediate transfer belt 31 by removing unwanted objects such as toner or paper dust adhering to the outer peripheral surface.

As illustrated in FIG. 2, in the intermediate transfer unit 30, a part where the second transfer device 35 is in contact with the outer peripheral surface of the intermediate transfer belt 31 is a second transfer position TP2 where the toner images are secondly transferred.

The intermediate transfer belt 31 is an endless belt having a semiconductive toner holding surface as its outer peripheral surface. The intermediate transfer belt 31 is supported by a plurality of support rollers 32*a* to 32*e* while keeping a desired shape to rotate (circulate) in a direction indicated by an arrow B sequentially through the first transfer positions of the image forming units 20 (Y, M, C, K).

The support roller 32*a* serves as a driving roller and a second transfer backup roller. The support roller 32*b* serves as a cleaning backup roller for the belt cleaner 36. The support roller 32*c* serves as a tension roller. The support rollers 32*d* and 32*e* serve as surfacing rollers that form a first transfer surface of the intermediate transfer belt 31. On an inner side of the intermediate transfer belt 31, the contact type first transfer devices 25 of the image forming units 20 (Y, M, C, K) are arranged so that the intermediate transfer belt 31 is pressed against the photoconductor drums 21.

For example, the second transfer device 35 is a contact type transfer device having a second transfer roller that presses the intermediate transfer belt 31 against the support roller 32*a* and is supplied with a second transfer bias.

As illustrated in FIG. 1 and FIG. 2, the paper guide member 6 is arranged at a position close to an outlet side of the second transfer position TP2 of the intermediate transfer unit 30 in a state in which the paper guide member 6 extends in a width direction of the paper 9 during transport and is located close to a non-transfer surface (back surface) 9*r* of the paper 9 that is opposite to a transfer surface 9*s* where the toner images are transferred.

As illustrated in FIG. 2, the paper guide member 6 is used in combination with a static elimination member 7 subjected to grounding or the like.

Details of the paper guide member 6 are described later.

The paper feeder 40 is arranged below the image forming units 20 (Y, M, C, K) in the housing 10 and includes, for example, a paper container 41, a feeder 43, and other devices.

The paper container 41 is a containing member that has a stacking plate 42 capable of stacking and containing a plurality of sheets of paper 9 of desired dimensions and type in a desired direction and is attached so that the paper container 41 may be drawn out of the housing 10 for operations such as replenishment with the paper 9. The feeder 43 feeds the sheets of paper 9 stacked on the stacking plate 42 of the paper container 41 one by one in order from the top by using a plurality of rollers and the like.

The fixing unit 50 is arranged above the second transfer position TP2 of the intermediate transfer unit 30 in the housing 10 and includes, for example, a heating rotator 51, a pressurizing rotator 52, and other devices arranged in an internal space of a housing 53.

The housing 53 is a structural object having an inlet and an outlet of the paper 9. The heating rotator 51 is a roller-shaped or belt-nip-shaped structural part that is heated by a heat source (not illustrated) to keep a desired temperature and rotates in a direction indicated by an arrow. The pressurizing rotator 52 is a roller-shaped or belt-nip-shaped structural part that rotates in conjunction with the heating rotator 51 while being in contact with the heating rotator 51 under a desired pressure.

In the fixing unit 50, a part where the heating rotator 51 is in contact with the pressurizing rotator 52 is a fixing nip part FN where a fixing process (heating and pressurizing) is performed when the paper 9 having the unfixed toner images transferred thereto passes through the fixing nip part FN.

As illustrated in FIG. 1, the image forming apparatus 1 is provided with the following transport paths Rt in the housing 10.

A paper feed transport path Rt1 is provided between the feeder 43 of the paper feeder 40 and the second transfer position TP2 of the intermediate transfer unit 30. A pair of transport rollers 44 that nips and transports the paper 9 and a transport guide member (not illustrated) that guides the transport of the paper 9 while securing a transport space for the paper 9 are arranged on the paper feed transport path Rt1. The transport rollers 44 serve as so-called registration rollers that correct a skew of the paper 9 and adjust a paper feed timing.

A relay transport path Rt2 including a paper guide member (not illustrated) is provided between the second transfer position TP2 of the intermediate transfer unit 30 and the fixing nip part FN of the fixing unit 50.

A paper output transport path Rt3 including a pair of output rollers 48 and a transport guide member (not illustrated) is provided between a paper output side of the fixing unit 50 and a paper output port located back from the paper output/reception part 12.

Image Forming Operation of Image Forming Apparatus

At a timing of an image forming operation of the image forming apparatus 1, toner images corresponding to image information are formed on the photoconductor drums 21 of all or a subset of the image forming units 20 (Y, M, C, K), firstly transferred onto the intermediate transfer belt 31 of the intermediate transfer unit 30, and secondly transferred by the second transfer device 35 onto one side (transfer surface) 9*s* of the paper 9 fed from the paper feeder 40 to the second transfer position TP2 via the paper feed transport path Rt1 (FIG. 2).

As illustrated in FIG. 2, the paper 9 that starts to be output from the second transfer position TP2 after the toner images are secondly transferred is guided by the paper guide member 6 and introduced into the fixing nip part FN of the fixing unit 50 via the relay transport path Rt2 while static electricity on the back surface 9*r* that is the non-transfer surface is eliminated by the static elimination member 7. The paper 9 having the toner images fixed by the fixing unit 50 through the fixing process is received by being transported to the paper output/reception part 12 via the paper output transport path Rt3.

Through the operation described above, an image is formed on the one side (9*s*) of the paper 9 by the image forming apparatus 1. The image that may be formed by the image forming apparatus 1 is a multicolor image or a monochrome image.

Back Smear of Paper

Figure 9A:
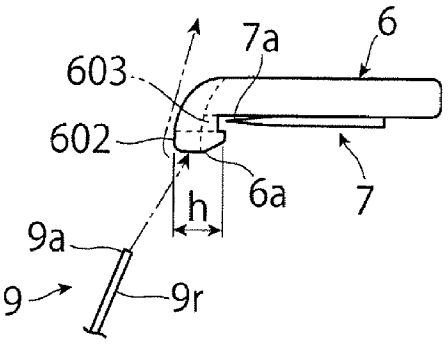
FIG. 9A RELATED ART
FIG. 9A illustrates a cause of a back smear of paper.
Figure 9B:
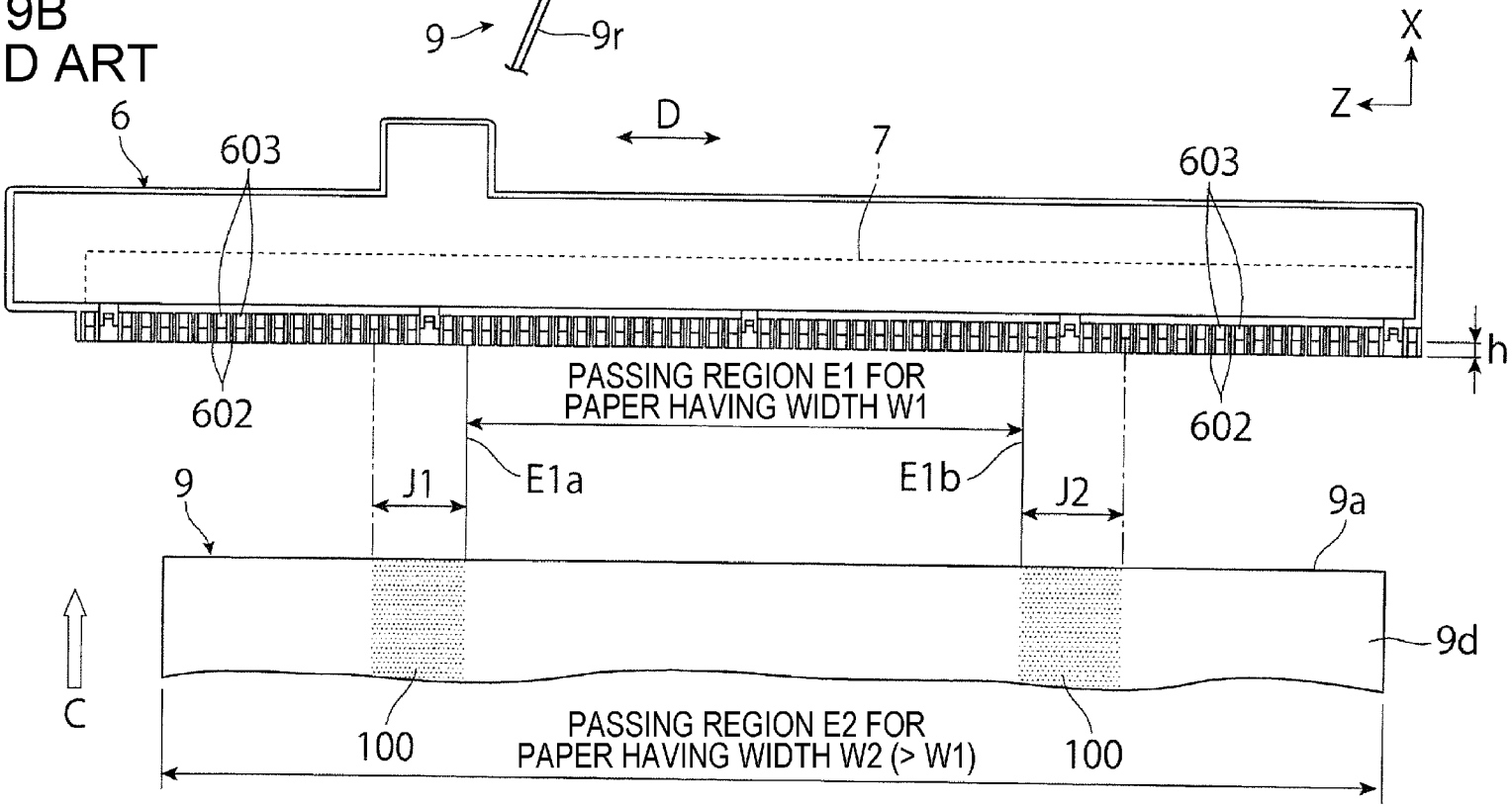
FIG. 9B RELATED ART
FIG. 9B illustrates a state in which the back smear of paper occurs.

As exemplified in FIGS. 9A and 9B, back smears 100, which are adhesion of toner to the back surface 9*r* of paper 9 having a relatively larger width W2 (>W1) than a width W1 of preceding paper among the sheets of paper 9 guided by the paper guide member 6 so that static electricity is eliminated by the static elimination member 7 after the toner images are transferred, may occur in the image forming apparatus 1 including the paper guide member 6.

As exemplified in FIG. 9B, the paper guide member 6 has a plurality of thread-shaped protrusions 602 provided substantially at regular intervals and extending in a passing direction C of the paper 9 to guide the paper 9 after the toner images are transferred so that the paper 9 passes with a distance secured from the static elimination member 7 that eliminates static electricity in proximity to the paper 9 in a width direction D of the paper 9 during transport.

The plurality of thread-shaped protrusions 602 adjoin each other across each slit 603 in the width direction D of the paper 9. The slit 603 is an opening for exerting a static elimination effect in a state in which a portion of one end of the static elimination member 7 (protruding end) faces the back surface 9*r* of the paper 9 via a space.

FIG. 9B illustrates the surface of the paper guide member 6 after the paper 9 has passed. Reference symbol h of FIGS. 9A and 9B represents a height of the thread-shaped protrusion 602, which is also a separation dimension from a protruding end 7*a* of the static elimination member 7. The heights h of all of the plurality of thread-shaped protrusions 602 are equal in the width direction D of the paper 9.

The back smear 100 of the paper 9 occurs for the following reason.

That is, as exemplified by the chain line arrow in FIG. 9A, the preceding paper 9 having the relatively small width W1 may be guided after its leading edge 9*a* is temporarily brought into contact with an upstream end 6*a* of the paper guide member 6 in the passing direction C of the paper 9 (strictly, upstream ends of the plurality of thread-shaped protrusions 602 in the passing direction C of the paper 9 and a coupling part that couples the ends). During the contact, a portion of the toner forming the unfixed toner images on the paper 9 flies and adheres to the tops of the thread-shaped protrusions 602 of the paper guide member 6.

When the succeeding paper 9 having the larger width W2 (>W1) than the preceding paper 9 passes, the toner adhering to the paper guide member 6 adheres to a portion of the back surface 9*r* that is the non-transfer surface of the succeeding paper 9 by being transferred when the toner is in contact with the back surface 9*r*. This toner adhesion is the back smear 100.

Research conducted by the inventors reveals that the adhesion of the flying toner to the paper guide member 6 tends to occur in partial regions J1 and J2 of non-passing regions on an outer side of both ends E1*a* and E1*b* of a passing region E1 of the paper guide member 6 where the preceding paper 9 having the relatively small width W1 passes. The research also reveals that the outer regions J1 and J2 where the flying toner adheres each tend to have, for example, a width of about 15 mm to 17 mm in the width direction D of the paper 9.

Structure of Paper Guide Member

In the image forming apparatus 1, the paper guide member 6 has the following structure.

As illustrated in, for example, FIG. 3 to FIG. 6, the paper guide member 6 includes a planar (for example, substantially rectangular) plate-shaped body 61 that is long in one direction, a plurality of thread-shaped protrusions 62 that are provided substantially at regular intervals S at one long-side end of the body 61 and guide the paper 9 after the toner images are transferred so that the paper 9 passes with a distance secured from the static elimination member 7, and a plurality of slits 63 each provided between adjacent thread-shaped protrusions 62.

Figure 5:
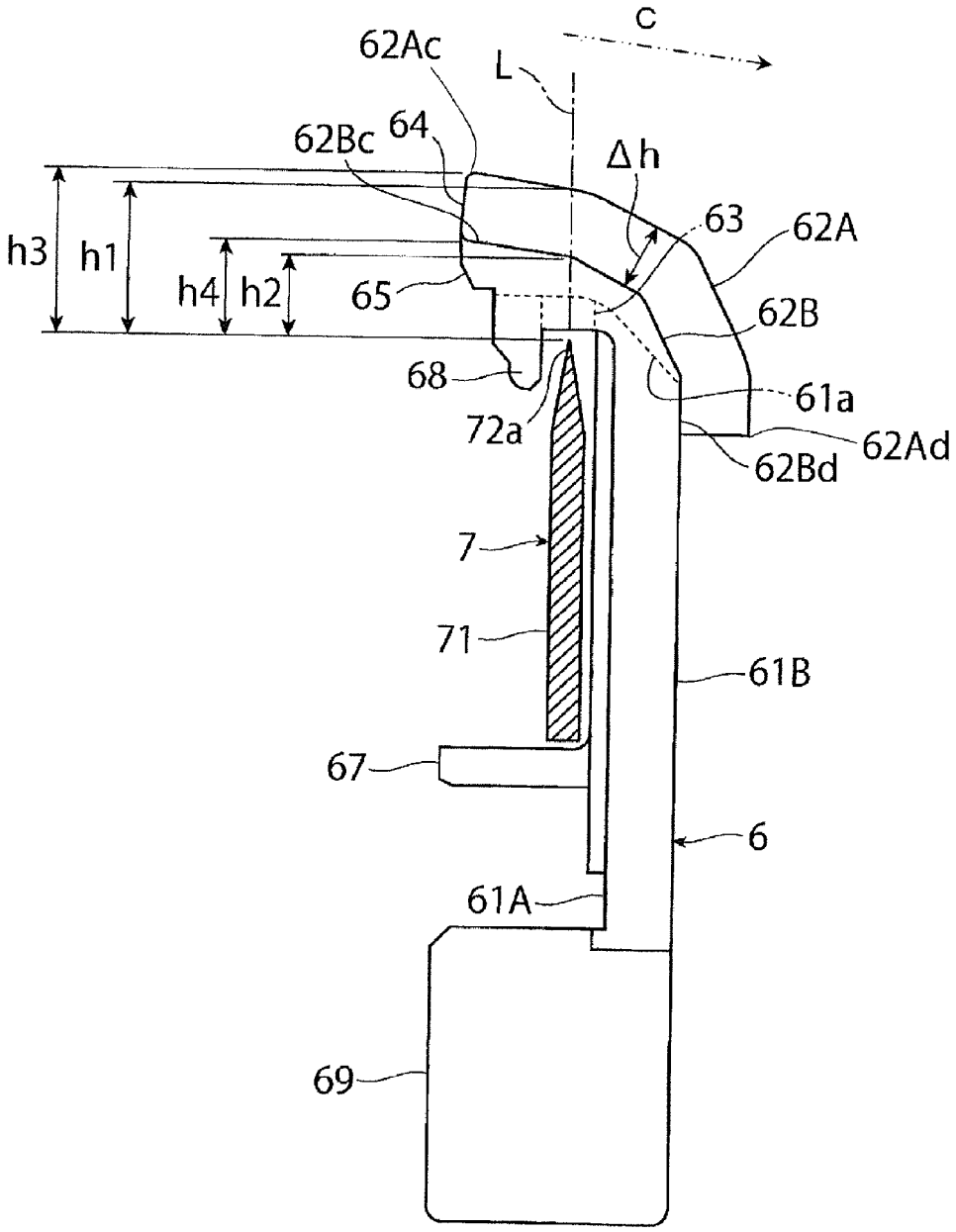
FIG. 5 is a partial sectional view taken along the line V-V of the paper guide member of FIG. 4.
Figure 6:
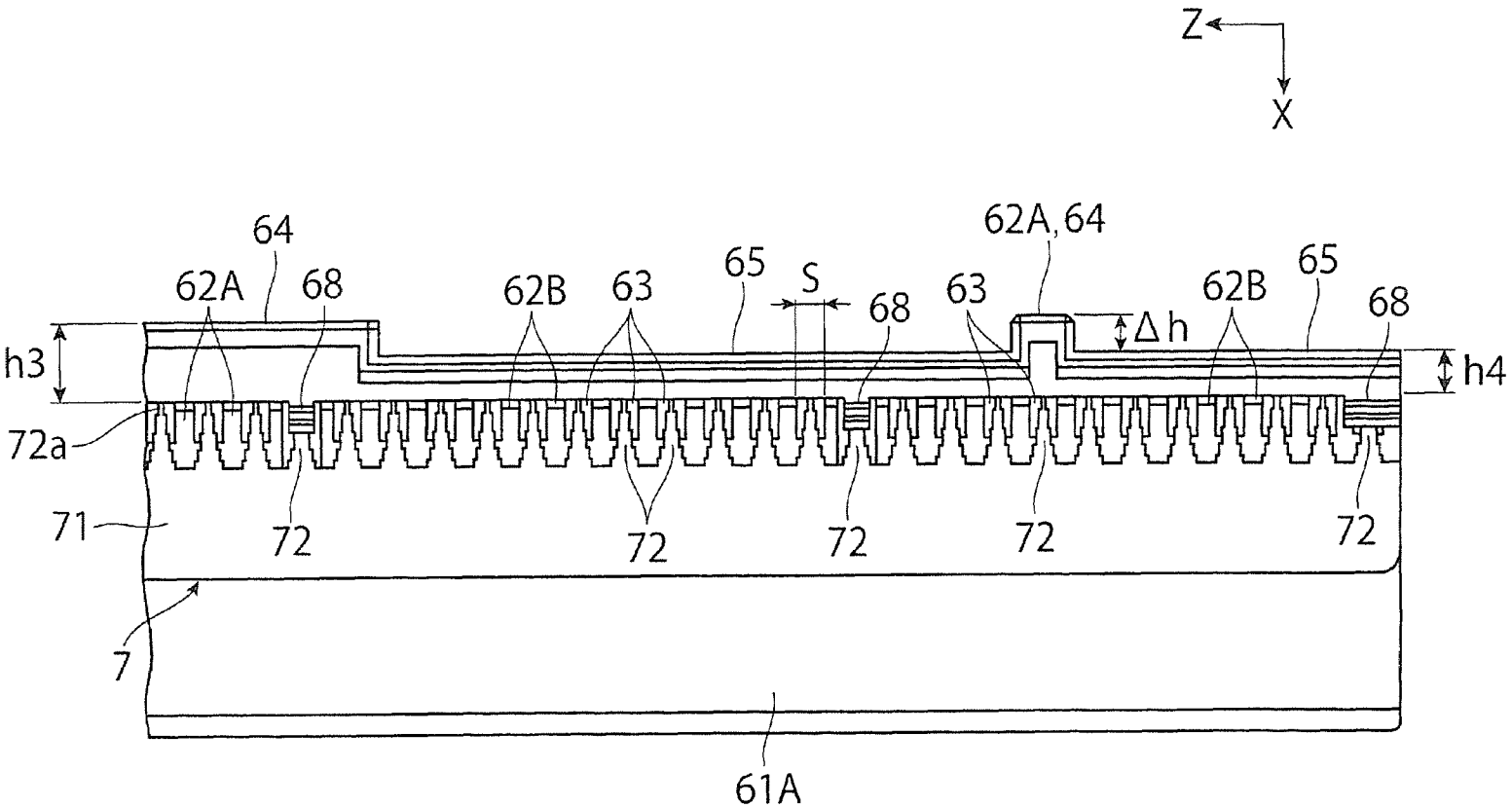
FIG. 6 is a partially enlarged view of the paper guide member in the upper part of FIG. 4.
Figure 7:
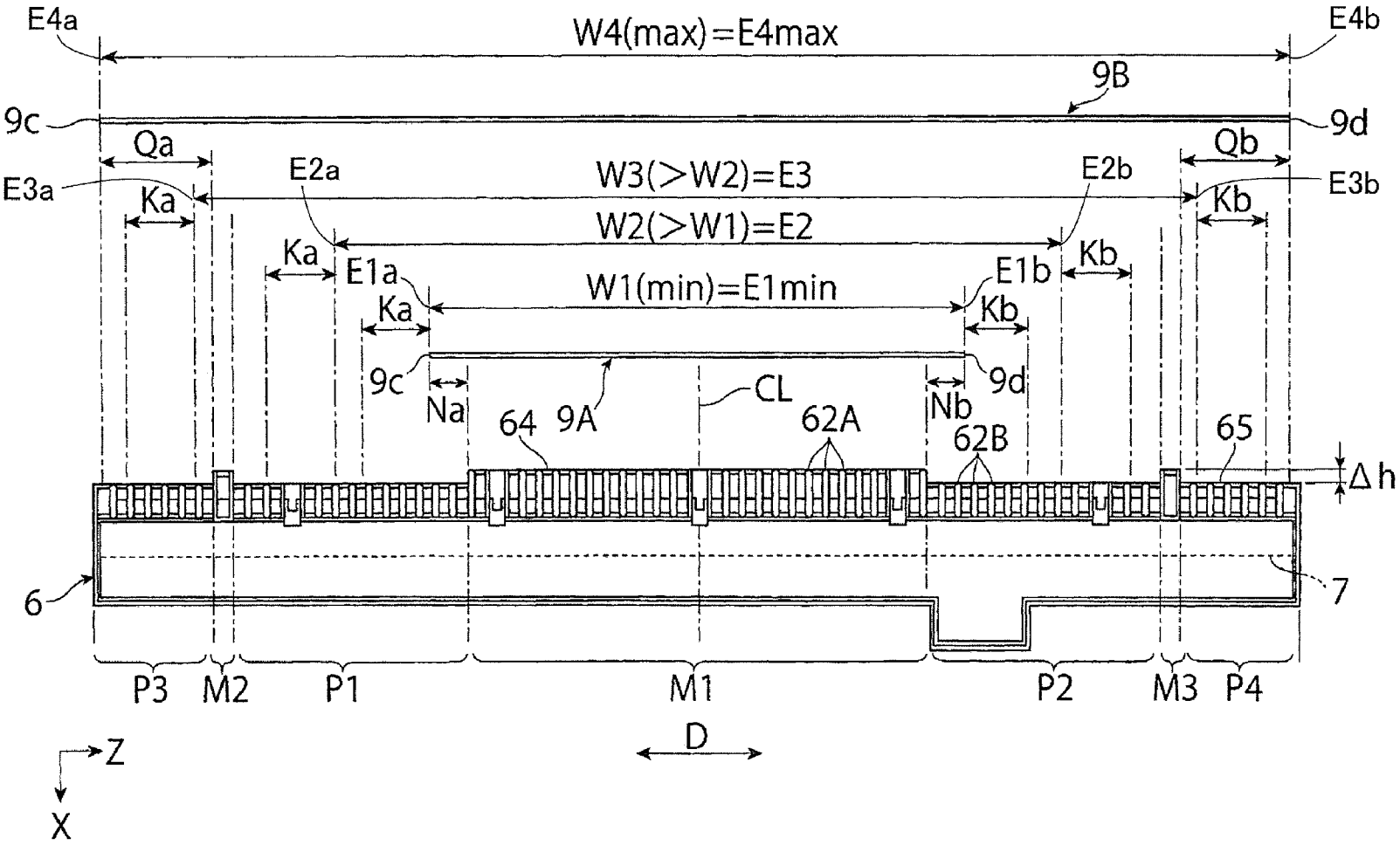
FIG. 7 illustrates the structure of thread-shaped protrusions of the paper guide member in the lower part of FIG. 4.

As illustrated in, for example, FIG. 5 to FIG. 7, the plurality of thread-shaped protrusions 62 of the paper guide member 6 include first thread-shaped protrusions 62A each having a height at which the paper 9 is supported and guided, and second thread-shaped protrusions 62B each having a height smaller than the height of the first thread-shaped protrusion 62A and present in regions P on an outer side of both ends Ea (E1*a* to E4*a*) and Eb (E1*b* to E4*b*) in the width direction of a passing region E (E1 to E4) where paper 9 having each width W (W1 to W4) for use in the image forming apparatus 1 passes.

As illustrated in FIG. 7, the paper guide member 6 is used in a so-called center registration transport system in which the paper 9 having each width W is transported while the center point in the width direction D is aligned with the center position of the paper guide member 6 (position indicated by a chain line CL).

Figure 3:
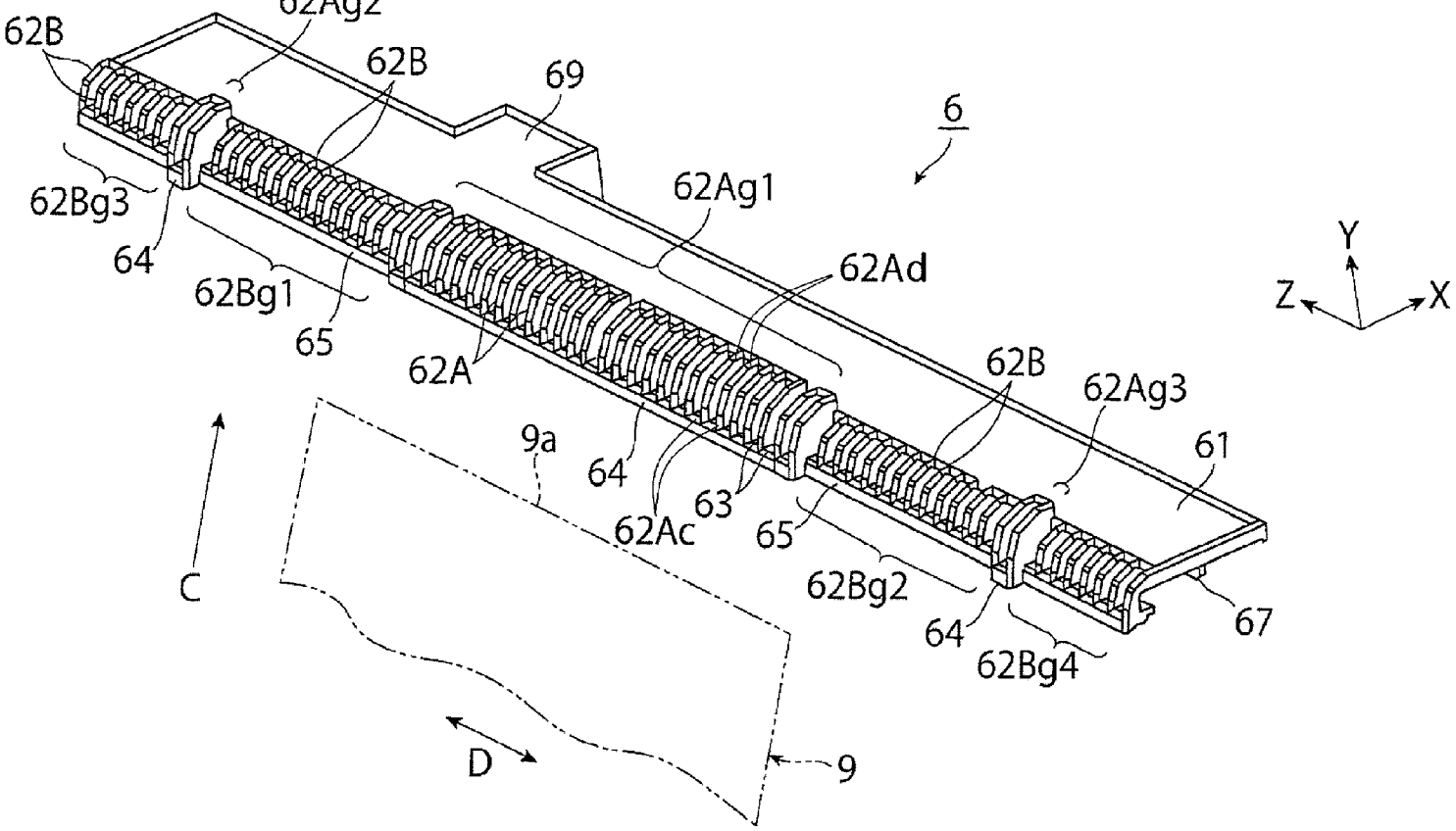
FIG. 3 is a perspective view illustrating the structure of a paper guide member according to the exemplary embodiment.

As illustrated in FIG. 3 and FIG. 5, the thread-shaped protrusions 62 including the first thread-shaped protrusions 62A and the second thread-shaped protrusions 62B are formed at one long-side end 61*a* of the body 61 as parts (ribs) shaped to jut out toward an upstream side in the passing direction C of the paper 9 and extend in the passing direction C of the paper 9. As illustrated in FIG. 3 and FIG. 5, each of the first thread-shaped protrusions 62A and the second thread-shaped protrusions 62B of the thread-shaped protrusions 62 is formed as a projection shaped with an outer diameter line (ridge) curved continuously from an upstream end 62Ac or 62Bc to a downstream end 62Ad or 62Bd in the passing direction C of the paper 9.

Figure 4:
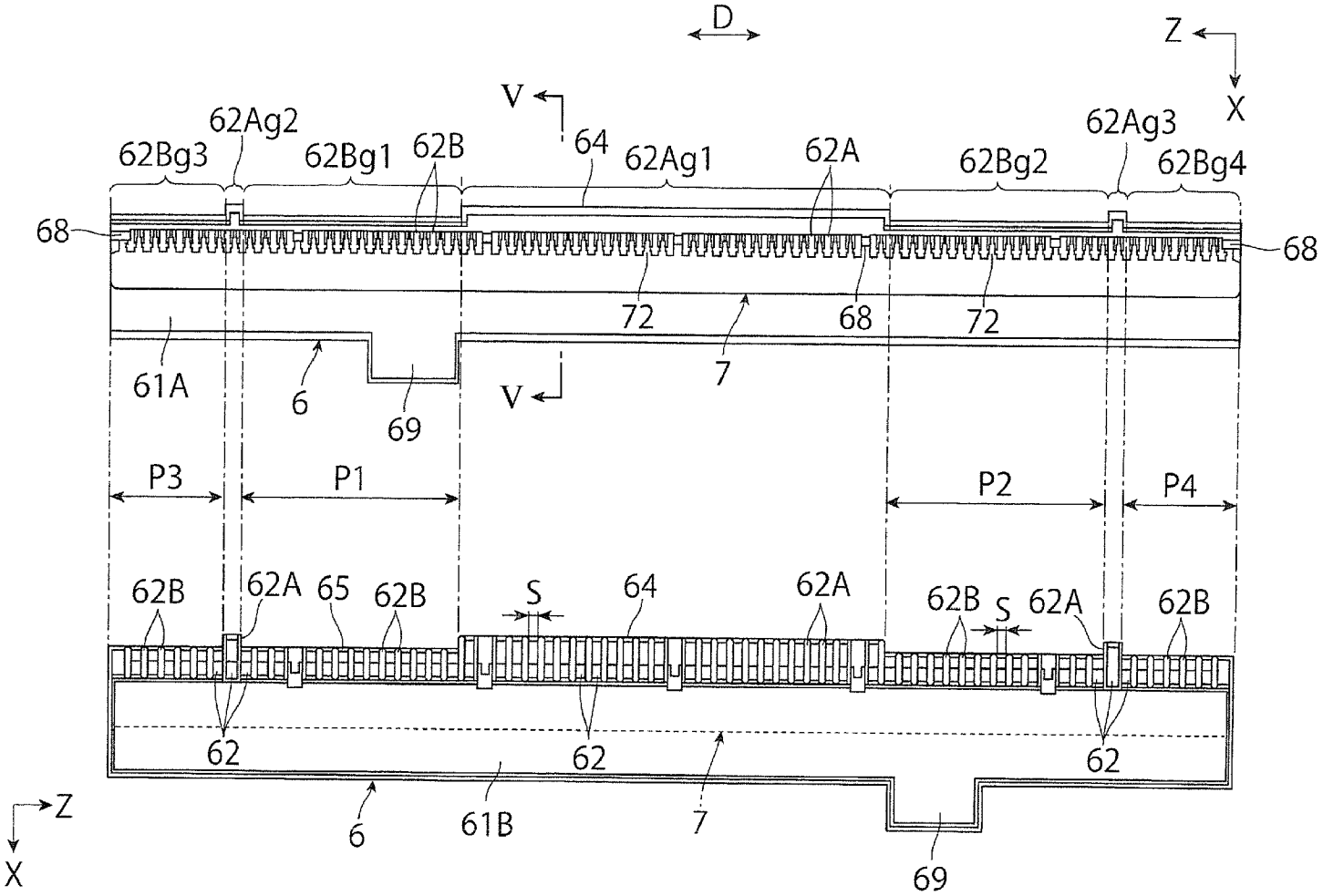
FIG. 4 illustrates the paper guide member of FIG. 3, in which an upper part of FIG. 4 illustrates the paper guide member viewed from an upstream side in a passing direction of paper and a lower part of FIG. 4 illustrates the paper guide member viewed from a downstream side in the passing direction of the paper.

As illustrated in FIG. 3 and FIG. 4, when the plurality of thread-shaped protrusions 62 are observed in the width direction D of the paper 9, the first thread-shaped protrusion 62A is a higher part (projection) that protrudes relative to the second thread-shaped protrusion 62B and the second thread-shaped protrusion 62B is a lower part (recess) that recedes relative to the first thread-shaped protrusion 62A.

As illustrated in FIG. 4 to FIG. 6, the slit 63 is an opening for exerting the static elimination effect in a state in which a portion 72*a* of one end of the static elimination member 7 (protruding end) faces the back surface 9*r* that is the non-transfer surface of the paper 9 via a space. For example, the slit 63 is formed as a through hole having a rectangular opening.

As illustrated in FIG. 4 and FIG. 5, the static elimination member 7 is formed in a state in which a plurality of projections (protruding ends) 72 having pointed tips are arrayed at regular intervals at one long-side end of a planar (for example, rectangular) plate-shaped conductive base 71 that is long in one direction.

The static elimination member 7 is used by being attached to an upstream side surface 61A of the body 61 of the paper guide member 6 in the passing direction C of the paper 9. At this time, the static elimination member 7 is attached in a state in which all the protruding ends 72*a* of the plurality of projections 72 are located stationarily near inner inlets of the slits 63. The static elimination member 7 is connected to a grounding member (not illustrated). The body 61 has a downstream side surface 61B in the passing direction C opposite the upstream side surface 61A in the passing direction C.

In FIG. 5 and FIG. 6, reference symbol 67 represents a support part that supports the other long-side end of the conductive base 71 of the static elimination member 7 provided on the body 61 of the paper guide member 6. Reference symbol 68 represents a holding part that holds each of the protruding ends of several projections 72 among the plurality of projections 72 of the static elimination member 7 provided on the body 61 in a state in which the protruding end is inserted. Reference symbol 69 represents an attachment part by which the paper guide member 6 is positioned and attached to a mount (not illustrated).

As illustrated in FIG. 5, the first thread-shaped protrusions 62A each have a height h2 at which the paper 9 may be supported and guided in a state in which the paper 9 is kept away by a desired distance from the protruding ends 72*a* of the plurality of projections 72 of the static elimination member 7.

The height h1 is a separation distance from the protruding ends 72*a* of the projections 72 of the static elimination member 7. A chain line L of FIG. 5 is a reference extension line extending from the protruding end 72*a* of the projection 72 through the slit 63 substantially parallel to the surface of the conductive base 71 of the static elimination member 7.

As illustrated in FIG. 7, the first thread-shaped protrusions 62A are provided as one first thread-shaped protrusion group 62Ag1 in which the plurality of first thread-shaped protrusions 62A are collectively present in a region M1 close to the center and narrower than the minimum passing region E1 (*min*) where paper 9A having the minimum width W1 (*min*) passes among the sheets of paper 9 available in the image forming apparatus 1. Further, the first thread-shaped protrusions 62A are provided as one first thread-shaped protrusion group 62Ag2 and one first thread-shaped protrusion group 62Ag3 in which the plurality of first thread-shaped protrusions 62A are collectively present in outer regions M2 and M3 located outwardly away from both the ends E1*a* and E1*b* of the minimum passing region E1min, respectively.

The region M1 close to the center where the first thread-shaped protrusion group 62Ag1 is present has a width smaller by dimensions Na and Nb inwardly from both the ends E1*a* and E1*b* of the minimum passing region E1 (*min*), respectively.

For example, even if the paper 9A having the minimum width W1 (*min*) passes while deviating slightly in the width direction D from the region M1 close to the center, the first thread-shaped protrusion 62A present at each end of the first thread-shaped protrusion group 62Ag1 is hardly exposed from an end 9*c* or 9*d* of the paper 9A, thereby reducing or avoiding the occurrence of a case in which a portion of the toner forming the toner images on the paper 9A adheres to the first thread-shaped protrusion 62A present at the end of the first thread-shaped protrusion group 62Ag1. Therefore, the inward dimensions Na and Nb are set to appropriate values (for example, several millimeters) in consideration of a deviation amount of the paper 9 in the width direction D or from the viewpoint of stably guiding the paper 9.

As illustrated in FIG. 7, each of the outer regions M2 and M3 where the first thread-shaped protrusion groups 62Ag2 and 62Ag3 are present is one region located inwardly away from the end E4*a* or E4*b* of the maximum passing region E4max where paper 9B having the maximum width W4 (*max*) passes among the sheets of paper 9 available in the image forming apparatus 1.

The outer regions M2 and M3 are present inwardly away by predetermined distances Qa and Qb from both the ends E4*a* and E4*b* of the maximum passing region E4max, respectively. The distances Qa and Qb need to be set to dimensions at which portions close to both ends 9*c* and 9*d* of the paper 9B having the maximum width W4 (*max*) may be guided stably. If the outer regions M2 and M3 overlap all or a subset of the outer regions P where the second thread-shaped protrusions 62B are provided, the distances Qa and Qb need to be set to dimensions at which the outer regions M2 and M3 may avoid overlapping the regions P where the second thread-shaped protrusions 62B are provided.

As illustrated in FIG. 3 to FIG. 5, in the plurality of first thread-shaped protrusions 62A present in each of the first thread-shaped protrusion groups 62Ag1, 62Ag2, and 62Ag3, the upstream ends 62Ac in the passing direction C of the paper 9 are coupled by a first coupling part 64 extending in the width direction D of the paper 9. The downstream ends of the first thread-shaped protrusions 62A are coupled by the body 61.

In FIG. 5 and FIG. 6, reference symbol h3 represents a height dimension corresponding to a height difference between the upstream end 62Ac of the first thread-shaped protrusion 62A and the protruding end 72*a* of the projection 72 of the static elimination member 7.

As illustrated in FIG. 3, FIG. 4, FIG. 7, and the like, the heights h1 and h3 of all of the plurality of first thread-shaped protrusions 62A present in each of the first thread-shaped protrusion groups 62Ag1, 62Ag2, and 62Ag3 are equal in the width direction D of the paper 9.

As illustrated in FIG. 5 and the like, the second thread-shaped protrusions 62B each have a height h2 (<h1) smaller than the height h1 of the first thread-shaped protrusion 62A.

The height h2 is a separation distance from the protruding ends 72*a* of the projections 72 of the static elimination member 7 similarly to the case of the height h1.

As illustrated in FIG. 5, the second thread-shaped protrusion 62B has a smaller height than the first thread-shaped protrusion 62A in the entire region from the upstream end 62Bc to the downstream end 62Bd in the passing direction C of the paper 9.

That is, the height h2 of the second thread-shaped protrusion 62B is a small height that causes a desired height difference Δh from the height h1 of the first thread-shaped protrusion 62A. The height difference Δh is substantially the same value in the entire region from the upstream end 62Bc to the downstream end 62Bd of the second thread-shaped protrusion 62B.

For example, the height difference Δh may be set from the viewpoint of reducing the back smear 100. For example, the height difference Δh may be set so that, when paper 9 having a width W relatively larger than the minimum width W1 (min) is supported and guided by the first thread-shaped protrusions 62A among the sheets of paper 9 available in the image forming apparatus 1, both the ends 9*c* and 9*d* in the width direction D (and the back surface 9*r*) of the paper 9 having the width W may pass while being kept away from and out of contact with the second thread-shaped protrusions 62B. In this case, the height difference Δh is set to, for example, 1 to 3 mm.

As illustrated in FIG. 7, the second thread-shaped protrusions 62B are provided in regions corresponding to at least predetermined dimensions Ka and Kb on an outer side of both the ends Ea and Eb of each passing region E (E1 to E4) where the paper 9 having each width W (W1 to W4) available in the image forming apparatus 1 passes.

For example, the dimensions Ka and Kb may be set in consideration of the values of the outer regions J1 and J2 (FIGS. 9A and 9B) where the flying toner adheres to cause the back smear 100 described above. The dimensions Ka and Kb of the exemplary embodiment are values (for example, about 20 mm) larger by about several millimeters than the values of the regions J1 and J2 (widths of about 15 mm to 17 mm mm).

The dimensions Ka and Kb may be equal values but may be different values if necessary.

For example, the regions where the second thread-shaped protrusions 62B are provided are set as follows in the exemplary embodiment. Description is made under the assumption that four types of width (W1 to W4) are provided as the width W of the paper 9 available in the image forming apparatus 1.

That is, as exemplified in FIG. 7, the regions where the second thread-shaped protrusions 62B are provided include all of Regions 1 corresponding to the predetermined dimensions Ka and Kb on the outer side of both the ends Ela and E1*b* of the minimum passing region E1min for the paper 9A having the minimum width W1 (*min*), Regions 2 corresponding to the predetermined dimensions Ka and Kb on the outer side of both the ends E2*a* and E2*b* of the passing region E2 for the paper 9 having the larger width W2 (>W1), and Regions 3 corresponding to the predetermined dimensions Ka and Kb on the outer side of both the ends E3*a* and E3*b* of the passing region E3 for the paper 9 having the even larger width W3 (>W2).

In the exemplary embodiment, even if a gap region is present between Region 1 and Region 2 or between Region 2 and Region 3 but there is no such risk that both the ends 9*c* and 9*d* of the paper 9 having the larger width W2 or the paper 9 having the even larger width W3 may be brought into contact with the second thread-shaped protrusions 62B due to slack, the gap region is also employed as the region where the second thread-shaped protrusions 62B are provided. For example, the gap region between Region 1 and Region 2 is employed as the region where the second thread-shaped protrusions 62B are provided.

The regions where the second thread-shaped protrusions 62B are provided may be set to include a region where the first thread-shaped protrusions 62A are not needed.

In the exemplary embodiment, as illustrated in FIG. 7, four second thread-shaped protrusion groups 62Bg1, 62Bg2, 62Bg3, and 62Bg4 in which the plurality of second thread-shaped protrusions 62B are present are provided in (free) regions where the first thread-shaped protrusion groups 62Ag1, 62Ag2, and 62Ag3 are not provided.

The second thread-shaped protrusion groups 62Bg1 and 62Bg2 are provided in regions between the first thread-shaped protrusion group 62Ag1 present in the region M1 close to the center and the first thread-shaped protrusion group 62Ag2 present in the outer region M2 and between the first thread-shaped protrusion group 62Ag1 and the first thread-shaped protrusion group 62Ag3 present in the outer region M3. The second thread-shaped protrusion groups 62Bg3 and 62Bg4 are provided in the remaining regions present on an outer side of the first thread-shaped protrusion groups 62Ag2 and 62Ag3 present on the outer side.

As illustrated in FIG. 3 to FIG. 5, in the plurality of second thread-shaped protrusions 62B present in each of the second thread-shaped protrusion groups 62Bg1, 62Bg2, 62Bg3, and 62Bg4, the upstream ends 62Bc in the passing direction C of the paper 9 are coupled by a second coupling part 65 extending in the width direction D of the paper 9. The downstream ends 62Bd of the second thread-shaped protrusions 62B are coupled by the body 61.

In FIG. 5 and FIG. 6, reference symbol h4 represents a height dimension corresponding to a height difference between the upstream end 62Bc of the second thread-shaped protrusion 62B and the protruding end 72*a* of the projection 72 of the static elimination member 7.

As illustrated in FIG. 3 to FIG. 7, the height of the second coupling part 65 is smaller than the height of the first coupling part 64.

In the exemplary embodiment, the height of the second coupling part 65 is a small height that causes the height difference Δh from the height of the first coupling part 64 as illustrated in FIG. 6 and FIG. 7.

Figure 8:
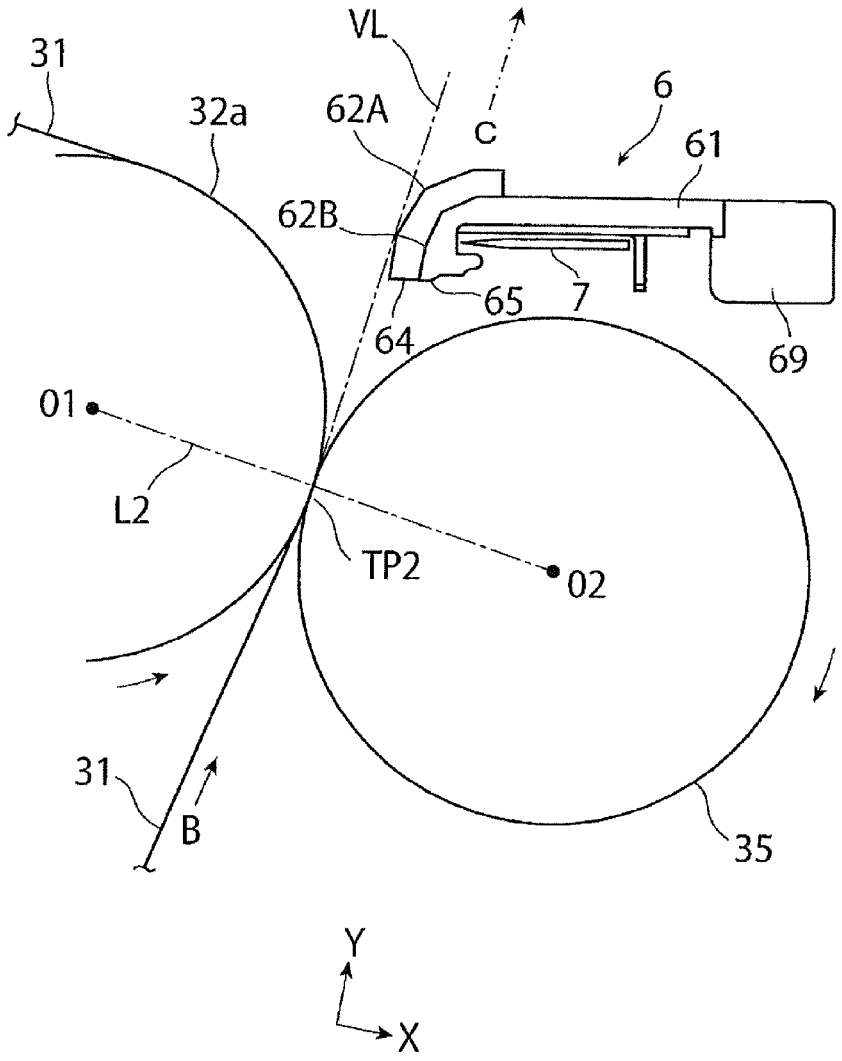
FIG. 8 illustrates an arrangement position and a use state of the paper guide member of FIG. 3.

As illustrated in FIG. 8, the paper guide member 6 constructed as described above is arranged at the position close to the outlet side of the second transfer position TP2 of the intermediate transfer unit 30 in the state in which the long-side end having the thread-shaped protrusions 62 extends in the width direction D of the paper 9 and the first thread-shaped protrusions 62A may guide the back surface 9*r* that is the non-transfer surface of the paper 9 in proximity to the back surface 9*r*. The first coupling parts 64 and the second coupling parts 65 of the paper guide member 6 face the outlet side of the second transfer position TP2.

In FIG. 8, a chain line L2 is a straight line connecting a rotation center 01 of the second transfer backup roller 32*a* and a rotation center 02 of the second transfer roller of the second transfer device 35. A chain line VL is an estimated output line of the paper 9 after the second transfer, which extends substantially orthogonally to the chain line L2 at the second transfer position TP2.

For example, the paper guide member 6 is manufactured by molding that uses a synthetic resin.

For example, as illustrated in FIG. 3 and FIG. 7, when the preceding paper 9A having the minimum width W1 (*min*) is guided to pass along the paper guide member 6 after the toner images are secondly transferred and when the paper 9A is guided to pass after its leading edge 9*a* is brought into contact with the first coupling part 64 or the second coupling part 65 of the paper guide member 6, a portion of the toner in the unfixed toner images on the paper 9A may fly and adhere to the second thread-shaped protrusions 62B (their ridges or the like) present in regions P1 and P2 on an outer side of both the ends E1*a* and E1*b* of the minimum passing region E1min for the paper 9A (in regions corresponding to the predetermined dimensions Ka and Kb on the outer side of both the ends E1*a* and E1*b*).

Even if, for example, the succeeding paper 9 having the larger width W2 is guided to pass along the paper guide member 6, a portion of the paper 9 having the width W2 on a center side in the width direction D is supported and guided by the plurality of first thread-shaped protrusions 62A in the first thread-shaped protrusion group 62Ag1 and the back surfaces 9*r* at both the ends 9*c* and 9*d* of the paper 9 pass while being kept away from and out of contact with the second thread-shaped protrusions 62B having the smaller heights h4 and h2 than the first thread-shaped protrusions 62A even when the back surfaces 9*r* pass along the outer regions P1 and P2.

As a result, there is no such risk that the toner in the outer regions P1 and P2 may be transferred and adhere to the back surface of the succeeding paper 9 having the larger width W2 than the preceding paper 9A.

Even if the paper 9 having the even larger width W3 or the paper 9B having the maximum width W4max passes after the preceding paper 9A, a substantially similar result is obtained despite a difference in that only the paper 9B is additionally supported and guided by the plurality of first thread-shaped protrusions 62A in the first thread-shaped protrusion groups 62Ag2 and 62Ag3 in the outer regions M2 and M3.

For example, if the preceding paper 9 is the paper 9 having the larger width W2, the paper 9 may be guided to pass after its leading edge 9*a* is brought into contact with the first coupling part 64 or the second coupling part 65 of the paper guide member 6 and a portion of the toner in the unfixed toner images may fly and adhere to the second thread-shaped protrusions 62B present in the regions P1 and P2 on an outer side of both the ends E2*a* and E2*b* of the passing region E2 for the paper 9 (in regions corresponding to the predetermined dimensions Ka and Kb on the outer side of both the ends E2*a* and E2*b*).

Even if, for example, the succeeding paper 9 having the even larger width W3 is guided to pass along the paper guide member 6, a portion of the paper 9 having the width W3 on a center side in the width direction D is supported and guided by the plurality of first thread-shaped protrusions 62A in the first thread-shaped protrusion group 62Ag1 and the back surfaces 9*r* at both the ends 9*c* and 9*d* of the paper 9 pass while being kept away from and out of contact with the second thread-shaped protrusions 62B having the relatively smaller heights h4 and h2 than the first thread-shaped protrusions 62A even when the back surfaces 9*r* pass along the outer regions P1 and P2.

As a result, there is no such risk that the toner in the outer regions P1 and P2 may be transferred and adhere to the back surface of the succeeding paper 9 having the even larger width W3 than the preceding paper 9 having the larger width W2.

Even if the paper 9B having the maximum width W4max passes after the preceding paper 9 having the larger width W2, a substantially similar result is obtained despite the difference in that the paper 9B is additionally supported and guided by the plurality of first thread-shaped protrusions 62A in the first thread-shaped protrusion groups 62Ag2 and 62Ag3 in the outer regions M2 and M3.

For example, if the preceding paper 9 is the paper 9 having the even larger width W3, the paper 9 may be guided to pass after its leading edge 9*a* is brought into contact with the first coupling part 64 or the second coupling part 65 of the paper guide member 6 and a portion of the toner in the unfixed toner images may fly and adhere to the second thread-shaped protrusions 62B present in regions P3 and P4 on an outer side of both the ends E3*a* and E3*b* of the passing region E3 for the paper 9 (in regions corresponding to the predetermined dimensions Ka and Kb on the outer side of both the ends E3*a* and E3*b*).

Even if the succeeding paper 9B having the maximum width W4max is guided to pass along the paper guide member 6, portions of the paper 9B on a center side in the width direction D and on an inner side of both the ends are supported and guided by the plurality of first thread-shaped protrusions 62A in the first thread-shaped protrusion group 62Ag1 and the plurality of first thread-shaped protrusions 62A in the first thread-shaped protrusion groups 62Ag2 and 62Ag3 and the back surfaces 9*r* at both the ends 9*c* and 9*d* of the paper 9B pass while being kept away from and out of contact with the second thread-shaped protrusions 62B having the relatively smaller heights h4 and h2 than the first thread-shaped protrusions 62A even when the back surfaces 9*r* pass along the outer regions P3 and P4.

As a result, there is no such risk that the toner in the outer regions P3 and P4 may be transferred and adhere to the back surface of the succeeding paper 9B having the maximum width W4max.

As described above, each of the plurality of second thread-shaped protrusions 62B of the paper guide member 6 has the smaller height than the first thread-shaped protrusion 62A in the entire region from the upstream end 62Bc to the downstream end 62Bd.

Even if, for example, the trailing edge of the succeeding paper 9 having the relatively large width W on the upstream side in the passing direction C passes in contact with the first thread-shaped protrusions 62A in proximity to the downstream ends 62Ad, the back surface 9*r* of the paper 9 passes out of contact with the second thread-shaped protrusions 62B, thereby eliminating the risk that the back smear may occur.

As described above, the second coupling part 65 that couples the upstream ends 62Bc of the second thread-shaped protrusions 62B in the paper guide member 6 has the height smaller than the height of the first coupling part 64 that couples the upstream ends 62Ac of the first thread-shaped protrusions 62A.

Even if the preceding paper 9 having the relatively small width W is guided to pass after its leading edge 9*a* is brought into contact with the first coupling part 64 or the second coupling part 65 and a portion of the flying toner adheres to the second coupling part 65, the back surface 9*r* of the succeeding paper 9 having the relatively large width W passes out of contact with the second coupling part 65 and the second thread-shaped protrusions 62B, thereby eliminating the risk that the back smear may occur.

As described above, all of the plurality of first thread-shaped protrusions 62A of the paper guide member 6 have equal heights in the width direction D.

Therefore, the succeeding paper 9 having the relatively large width W is stably supported and guided by the first thread-shaped protrusions 62A having equal heights in the width direction D and the back surfaces 9*r* at both the ends 9*c* and 9*d* in the width direction D are hardly brought into contact with the second thread-shaped protrusions 62B. Thus, the back smear hardly occurs.

If necessary, the plurality of first thread-shaped protrusions 62A may partially have, for example, relatively small heights except for the first thread-shaped protrusions 62A adjacent to the second thread-shaped protrusions 62B.

As described above, each of the outer regions P1 to P4 of the paper guide member 6 where the second thread-shaped protrusions 62B are present has a width larger than the interval S between the plurality of thread-shaped protrusions 62A and 62B.

Therefore, for example, the contact area between a portion of the second thread-shaped protrusion 62B that guides the paper 9 and the back surface of the paper 9 is reduced, thereby reducing the smear of the back surface of the paper 9.

MODIFIED EXAMPLES

The paper guide member 6 may guide sheets of paper 9 having two types of width W, three types of width W, or five or more types of width W.

The numbers of the first thread-shaped protrusions 62A and the second thread-shaped protrusions 62B of the paper guide member 6 and the widths and the number of the regions where the first thread-shaped protrusions 62A and the second thread-shaped protrusions 62B are provided may be changed depending on conditions such as the width of the paper 9 for use.

The image forming apparatus to which the paper guide member 6 is applied may employ a system in which the toner image is directly transferred (firstly transferred) onto the paper 9 without using the intermediate transfer unit 30.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A paper guide member configured to guide paper having a plurality of paper widths after a toner image is transferred to the paper, wherein paper passing regions, through which the paper passes, have widths corresponding to the plurality of paper widths, the paper guide member comprising:

a plurality of thread-shaped protrusions extending in a passing direction of the paper to guide the paper to pass with a distance secured from a static eliminator that eliminates static electricity in proximity to the paper in a width direction of the paper, the plurality of thread-shaped protrusions adjoining each other across a slit in the width direction of the paper, wherein the plurality of thread-shaped protrusions comprise:

first thread-shaped protrusions each having a height at which the paper is supported and guided and disposed in each of the paper passing regions; and second thread-shaped protrusions each having a height smaller than the height of each of the first thread-shaped protrusions and for each of the paper passing regions the second thread-shaped protrusions are disposed in a region outside of the paper passing region, wherein each of the second thread-shaped protrusions has the height smaller than the height of each of the first thread-shaped protrusions in an entire region from an upstream end to a downstream end in the passing direction of the paper.

2. The paper guide member according to claim 1, wherein for each of the paper passing regions the second thread-shaped protrusions are provided in a region outside of the paper passing region and corresponding to at least a predetermined dimension from an end of the paper passing region.

3. The paper guide member according to claim 1, wherein each of the regions where the second thread-shaped protrusions are disposed outside of a paper passing region has a width larger than an interval between the plurality of thread-shaped protrusions.

4. The paper guide member according to claim 1, wherein the first thread-shaped protrusions are present in a region having a width equal to or smaller than a width of a minimum paper passing region where paper having a minimum width passes, and in one or more outer regions located outside of the minimum paper passing region.

5. The paper guide member according to claim 4, wherein the outer regions comprise one or more regions located within a maximum passing region where paper having a maximum width passes.

6. The paper guide member according to claim 4, wherein the height of each of the first thread-shaped protrusions is equal in the width direction of the paper.

7. An image forming apparatus, comprising:

an image forming device that forms a toner image;

a transfer device that transfers, onto paper, the toner image formed by the image forming device;

a static eliminator that eliminates static electricity on the paper after the toner image is transferred by the transfer device in proximity to the paper in a width direction of the paper; and a paper guide device that guides the paper so that the paper passes with a distance secured from the static eliminator, wherein the paper guide device comprises the paper guide member according to claim 1.

8. A paper guide member configured to guide paper having a plurality of paper widths after a toner image is transferred to the paper, wherein paper passing regions, through which the paper passes, have widths corresponding to the plurality of paper widths, the paper guide member comprising:

a plurality of thread-shaped protrusions extending in a passing direction of the paper to guide the paper to pass with a distance secured from a static eliminator that eliminates static electricity in proximity to the paper in a width direction of the paper, the plurality of thread-shaped protrusions adjoining each other across a slit in the width direction of the paper, wherein the plurality of thread-shaped protrusions comprise:

first thread-shaped protrusions each having a height at which the paper is supported and guided and disposed in each of the paper passing regions;

second thread-shaped protrusions each having a height smaller than the height of each of the first thread-shaped protrusions and for each of the paper passing regions the second thread-shaped protrusions are disposed in a region outside of the paper passing region;

a first coupling part that couples upstream ends of the first thread-shaped protrusions in the passing direction of the paper; and a second coupling part that couples upstream ends of the second thread-shaped protrusions in the passing direction of the paper, wherein the second coupling part has a height smaller than a height of the first coupling part.

9. A paper guide member configured to guide paper having a plurality of paper widths after a toner image is transferred to the paper, wherein paper passing regions, through which the paper passes, have widths corresponding to the plurality of paper widths, the paper guide member comprising a plurality of thread-shaped protrusions extending in a passing direction of the paper to guide the paper to pass with a distance secured from static elimination means for eliminating static electricity in proximity to the paper in a width direction of the paper, the plurality of thread-shaped protrusions adjoining each other across a slit in the width direction of the paper, wherein the plurality of thread-shaped protrusions comprise:

first thread-shaped protrusions each having a height at which the paper is supported and guided and disposed in each of the paper passing regions; and second thread-shaped protrusions each having a height smaller than the height of each of the first thread-shaped protrusions and for each of the paper passing regions the second thread-shaped protrusions are disposed in a region outside of the paper passing region, wherein each of the second thread-shaped protrusions has the height smaller than the height of each of the first thread-shaped protrusions in an entire region from an upstream end to a downstream end in the passing direction of the paper.

* * * * *